US009439010B2

(12) United States Patent
Choi et al.

(10) Patent No.: US 9,439,010 B2
(45) Date of Patent: Sep. 6, 2016

(54) SYSTEM FOR TUNING AUDIO PROCESSING FEATURES AND METHOD THEREOF

(71) Applicant: SAMSUNG ELECTRONICS CO., LTD., Suwon-si (KR)

(72) Inventors: Jung-min Choi, Suwon-si (KR); Young-suk Song, Suwon-si (KR); Nak-jin Choi, Suwon-si (KR); Hae-kwang Park, Suwon-si (KR); Joon-ho Son, Yanggu-gun (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 316 days.

(21) Appl. No.: 14/053,959

(22) Filed: Oct. 15, 2013

(65) Prior Publication Data

US 2015/0043738 A1 Feb. 12, 2015

Related U.S. Application Data

(60) Provisional application No. 61/864,175, filed on Aug. 9, 2013.

(30) Foreign Application Priority Data

Sep. 27, 2013 (KR) ..... 10-2013-0115446

(51) Int. Cl.
*H04R 29/00* (2006.01)
*H04S 7/00* (2006.01)

(52) U.S. Cl.
CPC ..... *H04R 29/00* (2013.01); *H04S 7/301* (2013.01)

(58) Field of Classification Search
CPC ..... H04H 60/58; H04R 3/04; H04R 29/00; H04R 5/04; H04M 3/2236; H04M 3/223; H04S 7/307; H04S 7/301
USPC ..... 381/58, 56, 103, 60, 101
See application file for complete search history.

(56) References Cited

U.S. PATENT DOCUMENTS 7,164,771 B1 1/2007 Treurniet et al.
2008/0020807 A1* 1/2008 Kolano ..... H04M 1/24 455/569.1

(Continued)

FOREIGN PATENT DOCUMENTS

KR 10-2002-0054177 A 7/2002
KR 10-2006-0098726 A 9/2006

(Continued)

OTHER PUBLICATIONS

International Search Report dated May 20, 2014, issued by the International Searching Authority in counterpart International Application No. PCT/KR2013/009184.

(Continued)

*Primary Examiner* — Akelaw Teshale
(74) *Attorney, Agent, or Firm* — Sughrue Mion, PLLC

(57) ABSTRACT

An audio tuning system including: an interface configured to provide a test signal to a reference device and to a target device; and a controller configured to acquire a result of audio processing in response to the test signal from the reference device and a result of audio processing in response to the test signal from the target device; compare the results; and adjust an audio processing characteristic value of the target device to match that of the reference device based on a result of the comparison. The audio tuning system may automatically tune the audio characteristic of the target device to match the reference device.

17 Claims, 11 Drawing Sheets

(56) References Cited

U.S. PATENT DOCUMENTS

| | | | | |
|---|---|---|---|---|
| 2008/0249769 | A1* | 10/2008 | Baumgarte | G10L 25/69 704/227 |
| 2009/0238371 | A1* | 9/2009 | Rumsey | H04R 29/001 381/58 |
| 2010/0128902 | A1 | 5/2010 | Liu et al. | |
| 2011/0135103 | A1* | 6/2011 | Sun | H04R 29/00 381/58 |
| 2012/0057714 | A1* | 3/2012 | Lin | H04S 7/301 381/59 |
| 2012/0126856 | A1* | 5/2012 | Lee | H03K 5/24 327/74 |
| 2012/0278041 | A1 | 11/2012 | Haulick et al. | |

FOREIGN PATENT DOCUMENTS

| | | | |
|---|---|---|---|
| KR | 10-2007-0044646 | A | 4/2007 |
| KR | 10-2009-0125974 | A | 12/2009 |
| KR | 10-2013-0073047 | A | 7/2013 |
| WO | 2013/106366 | A1 | 7/2013 |

OTHER PUBLICATIONS

Written Opinion dated May 20, 2014, issued by the International Searching Authority in counterpart International Application No. PCT/KR2013/009184.

* cited by examiner

SYSTEM FOR TUNING AUDIO PROCESSING FEATURES AND METHOD THEREOF

CROSS-REFERENCE TO RELATED APPLICATIONS

This application claims priority from U.S. Provisional Patent Application No. 61/864,175, filed on Aug. 9, 2013 in United States Patent and Trademark Office, and Korean Patent Application No. 10-2013-0115446, filed on Sep. 27, 2013 in Korean Intellectual Property Office, the disclosures of which are incorporated herein by reference in their entirety.

BACKGROUND

1. Field

Systems and methods consistent with exemplary embodiments relate to tuning audio processing, and more particularly, to a system configured to compare performance of audio processing between a reference device and a target device, and tuning characteristics of an audio processing block according to a result of the comparison, and a method thereof.

2. Description of the Related Art

Advanced electronic technology has introduced a variety of forms of terminal apparatuses. Along with this, consumer needs for the performance of terminals has been increased and diversified.

Accordingly, the telecommunication industry and/or terminal manufacturers are trying to provide products with sufficient performance for meeting user needs. Audio performance is an important factor in deciding the performance of particular products.

Developers invest a great amount of time to measure audio performance and provide optimum tuning for the related products, to thus provide products with satisfactory audio performance.

In the related art, manual approaches are employed for repetitive measuring and tuning products to meet demands for satisfactory audio performance.

An electronic apparatus (or a mobile apparatus) includes various audio processing blocks in its audio processing path that may influence the audio performance of the product. These have certain degree of dependency on each other. In the related art, repetitive measuring is required during tuning, because it is not possible to independently determine performances of the audio processing blocks.

Accordingly, a great amount of time and effort are necessary for audio tuning. Furthermore, audio tuning may be cumbersome. Additionally, even terminal apparatuses that have been tuned may have variations of audio performance.

Because the related art does not have a device which is used as a reference for the tuning, there may be variations of audio performance in every tuning. Therefore, the reliability of the product may be severely deteriorated.

SUMMARY

Exemplary embodiments overcome the above disadvantages and other disadvantages not described above. Also, exemplary embodiments not required to overcome the disadvantages described above, and an exemplary embodiment may not overcome any of the problems described above.

One or more exemplary embodiments provide an audio tuning system and a method thereof are provided, in which audio processing performance is compared between a reference device and a target device, and the audio performance of the target device is optimized by performing audio tuning efficiently and conveniently.

According to an aspect of an exemplary embodiment, there is provided an audio tuning system including: an interface configured to provide a test signal to a reference device and to a target device; and a controller configured to acquire a result of audio processing in response to the test signal from the reference device and a result of audio processing in response to the test signal from the target device, compare the results, and adjust an audio processing characteristic value of the target device to match that of the reference device based on a result of the comparison.

The audio turning system may further include: a storage configured to store test signal information for each of a plurality of audio processing blocks; and an audio processor configured to regenerate a plurality of test signals according to the test signal information, wherein the controller is further configured to sequentially provide the reference device with the plurality of test signals via the interface, and sequentially acquire results of audio processing in response to the plurality of test signals at the plurality of audio processing blocks of the reference device.

The audio tuning system may further include a display configured to display a graphic user interface to control an audio tuning process of the target device.

The controller may be further configured to sequentially provide the target device with the plurality of test signals, sequentially acquire results of audio processing in response to the plurality of test signals at the plurality of audio processing blocks of the target device, and adjust, in a stepwise manner, audio processing characteristic values of the plurality of audio processing blocks of the target device.

The plurality of audio processing blocks of the target device and the reference device may include a gain set block, a filter block, and an auto gain controller (AGC) block, and the controller may be further configured to: provide the reference device and the target device with a first test signal to determine a gain characteristic of the gain set block of the reference device and a gain characteristic of the gain set block of the target device, and set a gain of the gain set block of the target device to match the gain characteristic of the gain set block of the reference device, provide the reference device and the target device with a second test signal to determine a filtering characteristic of the filter block of the reference device and a filtering characteristic of the filter block of the target device, and adjust a coefficient of a filtering function of the filter block of the target device to match the filtering characteristic of the filter block of the reference device, and provide the reference device and the target device with a third test signal to determine a gain adjustment characteristic of the AGC block of the reference device and a gain adjustment characteristic of the AGC block of the target device, and adjust a gain adjustment parameter of the AGC block of the target device to match the gain adjustment characteristic of the AGC block of the reference device.

The interface may be connected to a sound card which is configured to record an audio signal, that is output as a result of processing the test signal at the reference device and the target device, thereby acquiring the result of the audio processing, and the controller may be further configured to receive the result of audio processing from the sound card via the interface.

The plurality of audio processing blocks may include at least two blocks from among a gain set block, a filter block, an auto gain controller (AGC) block, an echo canceller block, and a noise suppression block.

According to an aspect of another exemplary embodiment, there is provided an audio tuning method of an audio tuning system, the audio tuning method including: providing a test signal to a reference device; acquiring a result of audio processing in response to the test signal from the reference device; providing the test signal to a target device; acquiring a result of audio processing in response to the test signal from the target device; and tuning the target device, the tuning including comparing the results of audio processing at the reference device and the target device, and adjusting an audio processing characteristic value of the target device to match an audio processing characteristic value of the reference device.

The test signal may include a plurality of test signals regenerated with respect to respective audio processing blocks in accordance with test signal information.

The providing the test signal to the reference device may include sequentially providing the plurality of test signals to reference device. The acquiring the result of audio processing in response to the test signal from the reference device may include sequentially acquiring results of audio processing at the plurality of audio processing blocks of the reference device.

The providing the test signal to the test device may include sequentially providing the plurality of test signals to test device. The acquiring the result of audio processing in response to the test signal from the test device may include sequentially acquiring results of audio processing at the plurality of audio processing blocks of the target device. The adjusting the audio processing characteristic value of the target device may include adjusting, in a stepwise manner, the audio processing characteristic values of the plurality of audio processing blocks of the target device, respectively.

The plurality of audio processing blocks may include: a gain set block, a filter block, and an auto gain controller (AGC) block. The tuning may include: comparing results of audio processing at the reference device and the target device in response to a first test signal which is to determine a gain characteristic of the gain set block of the reference device and a gain characteristic of the gain set block of the target device, and setting a gain of the gain set block of the target device to match the gain characteristic of the gain set block of the reference device according to a result of the comparison; comparing results of audio processing at the reference device and the target device in response to a second test signal which is to determine a filtering characteristic of the filter block of the reference device and a filtering characteristic of the filter block of the target device, and adjusting a coefficient of a filtering function used in the filter block of the target device to match the filtering characteristic of the filter block of the reference device; and comparing results of audio processing at the reference device and the target device in response to a third test signal which is to determine a gain adjustment characteristic of the AGC block of the reference device and a gain adjustment characteristic of the AGC block of the target device, and adjusting a gain adjustment parameter of the AGC block of the target device to match the gain adjustment characteristic of the AGC block of the reference device.

The results of audio processing in response to the test signals may be received from a sound card which acquires the results of audio processing by recording an audio signal outputted as a result of processing the test signals at the reference device and the target device.

The plurality of audio processing blocks may include at least two blocks from among a gain set block, a filter block, an auto gain controller (AGC) block, an echo canceller block, and a noise suppression block.

According to an aspect of another exemplary embodiment, there is provided an audio tuning system including: an interface configured to provide a test signal to a reference device and a target device; and a controller configured to receive a first result of audio processing of the test signal at the reference device and a second result of audio processing of the text signal at the target device, compare the first result with the second result, and adjust an audio processing characteristic value of the target device based on a result of the comparison.

The audio processing characteristic value of the target device may be adjusted to match an audio processing characteristic value of the reference device.

The audio turning system may further include a storage configured to store the test signal, wherein the test signal may include a plurality of test signals corresponding to each of a plurality of audio processing blocks, wherein the controller may be configured to: sequentially provide test signals of the plurality of test signal to the reference device which correspond to audio processing blocks of the reference device, sequentially provide the test signals to the target device, and sequentially acquire results of audio processing at the plurality of audio processing blocks of the reference device and the target device, respectively.

The controller may be further configured compare the acquired results of audio processing, and adjust, in stepwise manner, audio processing characteristic values of the plurality of audio processing blocks of the target device, based on a result of the comparing.

The plurality of audio processing blocks may include: a gain set block; a filter block; and an auto gain controller (AGC) block.

The plurality of audio processing blocks may include at least two blocks selected from the group consisting of: a gain set block, a filter block, an auto gain controller (AGC) block, an echo canceller block, and a noise suppression block.

According to various exemplary embodiments, efficient and convenient audio tuning may be provided to optimize audio performance of the target device. As a result, audio performance reliability of the target device may be improved, and efficient product development achieved.

BRIEF DESCRIPTION OF THE DRAWINGS

The above and/or other aspects will become more apparent by describing certain exemplary embodiments with reference to the accompanying drawings, in which.

DETAILED DESCRIPTION OF EXEMPLARY EMBODIMENTS

Figure 1:
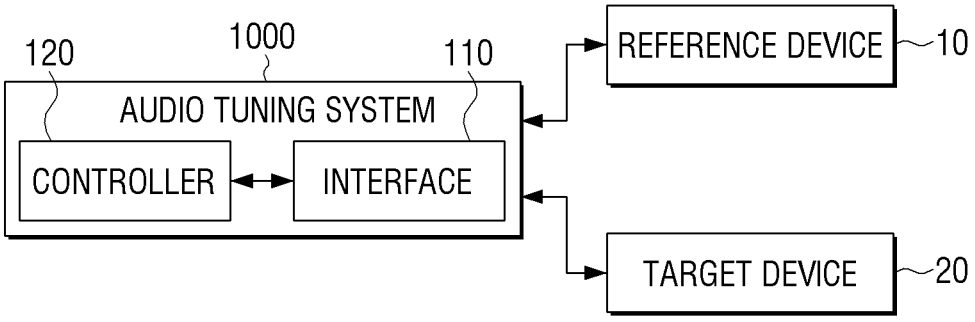
FIG. 1 is a block diagram illustrating a constitution and an operation of an audio tuning system according to an exemplary embodiment.

Certain exemplary embodiments will now be described in greater detail with reference to the accompanying drawings.

In the following description, same drawing reference numerals are used for the same elements, even in different drawings. The matters defined in the description, such as detailed construction and elements, are provided to assist in a comprehensive understanding of exemplary embodiments. Accordingly, it is apparent that exemplary embodiments may be carried out without those specifically defined matters. Also, well-known functions or constructions are not described in detail since they would obscure exemplary embodiments with unnecessary detail.

FIG. 1 is a block diagram illustrating a constitution and an operation of an audio tuning system according to an exemplary embodiment Referring to FIG. 1, an audio tuning system 1000 tests audio processing performance of a reference device 10 and a target device 20, respectively.

The audio tuning system 1000 compares the test results of the reference device 10 and the target device 20 with each other, and adjusts audio processing characteristic values of the target device 20 based on the comparison. As a result, the audio performance of the target device 20 may be matched with the reference device 10.

The 'reference device 10' as used herein refers to an apparatus with a reference audio processing performance. That is, an apparatus manufacturer may manufacture apparatuses in accordance with agreement with a telecommunication carrier that provides a communications network. Each telecommunication carrier may require different audio performances. For example, carrier A may require audio performance according to standard 1, while carrier B requires audio performance according to standard 2. For this, a reference model, which accommodates all the audio performance requirements of the carriers, can be made and used as the reference device 10.

The reference device 10 may also be a previous device model, which was already tuned to meet the audio performances as required by the respective carriers. That is, the reference device 10 may be a device 1 which is already in use and which is in compliance with the requirement of carrier A.

The 'target device 20' as used herein refers to an apparatus that is targeted for audio tuning. A manufacturer preparing to launch a new model has to perform audio tuning so that the model meets the audio performance required by the related telecommunication carrier. Accordingly, the model in need of audio tuning may be selected as the target device 20. The target device 20 will be also referred to as device under test (DUT).

A variety of devices can be the reference device 10 or the target device 20. More specifically, the audio tuning system 1000 may use various types of devices with audio outputting capability such as a mobile phone, a tablet personal computer (PC), a television (TV), a PC, a laptop PC, a personal digital assistant (PDA), an MP3 player, a home theater system, or an audio content playback apparatus, as the reference device 10 and the target device 20.

Referring to FIG. 1, the audio tuning system 1000 may include an interface 110 and a controller 120.

The interface 110 is configured to provide a test signal to each of the reference device 10 and the target device 20. The interface 110 may provide a test signal directly to the reference device 10 and the target device 20, or indirectly via a sound card (not illustrated), a network simulator (not illustrated), a speaker (not illustrated), an earphone (not illustrated), or a headset (not illustrated).

The controller 120 may acquire a result of audio processing from the reference device 10 and the target device 20 in response to providing the test signal and compare the same. The controller 120 may receive the result of audio processing directly from the reference device 10 and the target device 20, or indirectly via a separate means.

The controller 120 adjusts audio processing characteristic values of the target device 20 according to the result of the comparison of the audio processing results. Accordingly, the controller 120 may tune a plurality of audio processing blocks of the target device 20 to match the audio performance of the target device 20 to the reference device 10. That is, the audio performance of the target device 20 may be adjusted to be identical or within an acceptable range of the audio performance of the reference device 10, or within an acceptable range.

Accordingly, the audio performance of the target device 20 can be automatically optimized, i.e., without having to manually perform audio tuning repetitively.

The controller 120 may provide a plurality of test signals to the target device 20 in sequence, and independently acquire and analyze the result of audio processing of each of the plurality of audio processing blocks. Accordingly, the controller 120 may stepwise adjust the audio processing characteristic values of the plurality of audio processing blocks of the target device 20. As a result, even if there is a plurality of audio processing blocks, it is possible to independently analyze the characteristics of each audio processing block and tune the same in short time, by using the audio tuning system 1000. Accordingly, reliability of the target device 20 for audio performance improves, and the tuning time and processes are shortened and automated, which in turn result in a more efficient product development.

Figure 2:
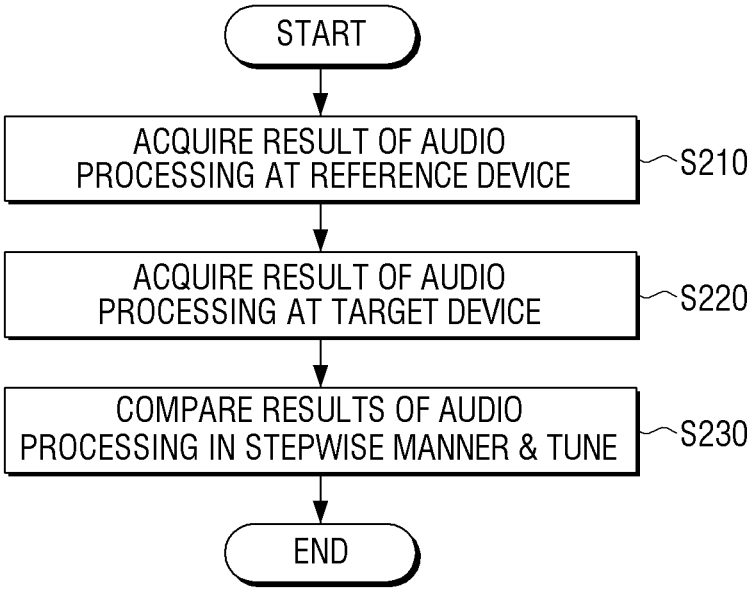
FIG. 2 is a flowchart illustrating an audio tuning method according to an exemplary embodiment.

FIG. 2 is a flowchart illustrating an audio tuning method according to an exemplary embodiment. Referring to FIG. 2, at operation S210, the audio tuning system 1000 performs a first test step in which an audio processing result at the reference device 10 is acquired. More specifically, the audio tuning system 1000 provides, in sequence, a preset test signal for each of the plurality of audio processing blocks used in the reference device 10. As the reference device 10 regenerates an audio signal in response to each test signal, the audio tuning system 1000 may acquire the result of audio processing at each of the plurality of audio processing blocks in a stepwise manner.

FIG. 2 illustrates an example in which all of the plurality of test signals are provided to the reference device 10, and the results of processing at all of the plurality of audio processing blocks of the reference device 10 are acquired, after which the results of processing at all of the plurality of audio processing blocks of the target device 20 are acquired. In the present exemplary embodiment, a user that performs audio tuning can connect the reference device 10 to the audio tuning system 1000 first, to acquire all the audio processing characteristics, and then connect the target device 20 to the audio tuning system 1000.

Thereafter, at operation S220, the audio tuning system performs a second test step in which an audio processing result of the target device 20 is acquired. More specifically, the audio tuning system 1000 provides, in sequence, the test signals that are identical to those that are provided to the reference device 10, and acquires the result of audio processing in a stepwise manner. At operation S230, the audio tuning system 1000 compares the result of audio processing at the target device acquired from each step with the result of audio processing at the reference device 10, and performs tuning.

That is, the audio tuning system 1000 compares the results of audio processing at the reference device 10 and the target device 20, respectively. As a result, the audio tuning system 1000 can analyze differences between the audio processing characteristics of the reference device 10 and that of the target device 20. Accordingly, at operation S230, the audio tuning system 1000 tunes the target device 20, by adjusting parameters or coefficients of a corresponding audio processing block to compensate for such differences. The tuning step will be described in greater detail below.

In another exemplary embodiment, a user may alternately connect the reference device 10 and the target device 20 to the audio tuning system 1000, to perform testing and tuning in stepwise manner.

In such an exemplary embodiment, a switch may be used. For example, both the reference device 10 and the target device 20 may be connected to the audio tuning system 1000 and the connection between one of the reference device 10 and the target device 20 to the audio tuning system 1000 may be controlled automatically or manually by the switch. In this exemplary embodiment, the audio processing characteristics of the reference device 10 and the target device 20 may be acquired alternately. That is, a first test signal to determine performance of the first audio processing block may be provided to the reference device 10 first so that the audio processing result thereof can be acquired, after which the first test signal is again provided to the target device 20 to acquire the audio processing result thereof. Next, a second test signal to determine performance of the second audio processing block may be provided to the reference device 10 first to thus acquire the audio processing result thereof, after which the second test signal may again be provided to the target device 20 to thus acquire corresponding audio processing result. The audio tuning system 1000 may repeatedly operate in the manner explained above, using each test signal, until the performance of the all the audio processing blocks is determined.

Figure 3:
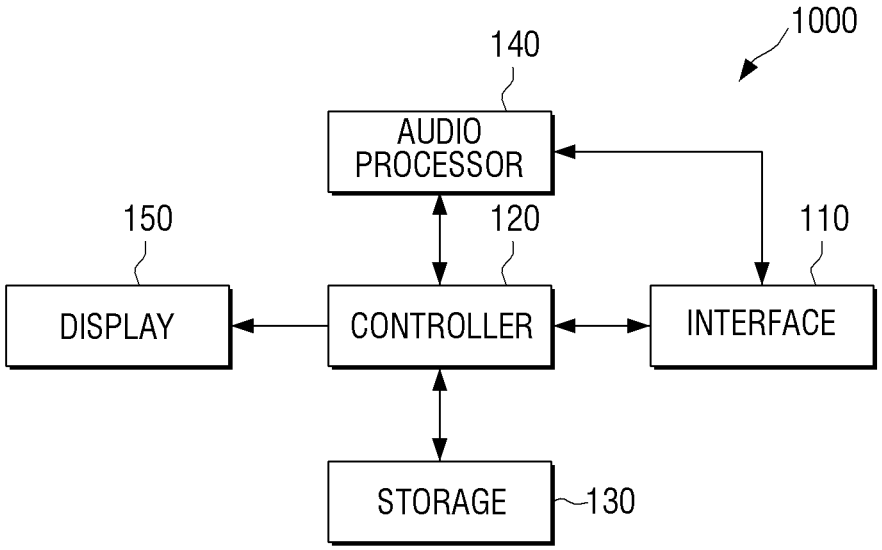
FIG. 3 is a detailed block diagram illustrating an audio tuning system according to an exemplary embodiment.

FIG. 3 is a detailed block diagram illustrating an audio tuning system according to an exemplary embodiment. Referring to FIG. 3, the audio tuning system 1000 includes an interface 110, a controller 120, a storage 130, an audio processor 140, and a display 150.

The interface 110 is configured to be connected to the reference device 10, the target device 20, or other devices for exchange of signals or data.

The controller 120 may provide a test signal to the reference device 10 and the target device 20 via the interface 110. It is possible to directly regenerate a test signal using the audio processor 140 and provide the same, or alternatively, test signal information may be provided to other external devices so that the external devices regenerate the test signal.

The storage 130 is configured to store preset test signals for each of a plurality of audio processing blocks. The plurality of audio processing blocks may include at least two various blocks including a gain set block, a filter block, an auto gain controller (AGC) block, an echo canceller block, or a noise suppression block. The gain set block is provided to set gains to amplify or damp an audio signal, and the filter block is provided to perform filtering by which a certain frequency band signal is blocked or passed. The AGC block is provided to perform an AGC operation, by which the gains are automatically adjusted using feedback. The echo canceller block is provided to remove an echo signal, and the noise suppression block is provided to reduce the size or number of noises included in the audio signal. Various forms of test signals that can best determine the characteristics of the other various blocks used in the audio processing can also be set.

Accordingly, the storage 130 may store test signal information which is necessary to regenerate a test signal set for each of the audio processing blocks. The test signal information may include frequency, amplitude, period, pattern, or signal functions. The test signal and the related test signal information may be determined and stored at the storage 130 in advance.

The storage 130 may also store applications or tools to analyze the result of audio processing performed at each audio processing block. That is, the storage 130 may store various program modules including, for example, a signal selection module to select a test signal, a signal generator module to regenerate the selected signal, a communication module to perform communication with a sound card or network simulator, a recording module to record the signal outputted from an external device, a signal analyzing module to analyze the signal by applying a stepwise algorithm, a parameter module to update a parameter set of the target device 20, or a programming module to program the updated parameter set to the system of the target device 20.

The controller 120 may analyze the result of audio processing, using the program modules stored at the storage 130, and tune the audio processing blocks of the target device 20 in a stepwise manner. This will be explained in greater detail below.

The audio processor 140 may regenerate a plurality of test signals, using the test signal information stored at the storage 130. The controller 120 may provide the reference device 10 with the plurality of test signals regenerated at the audio processor 140 via the interface 110, and acquire, in a stepwise manner, the results of audio processing at the respective audio processing blocks used in the reference device 10.

The controller 120 may also provide the target device 20 with the same test signal in sequence, to thus acquire the result of audio processing at the plurality of audio processing blocks used in the target device 20 in a stepwise manner. Accordingly, the controller 120 may compare the result of audio processing acquired from the reference device 10 with the result of audio processing acquired from the target device 20 to determine parameters or coefficients of the respective audio processing blocks of the target device 20, and thus make corresponding adjustments.

The display 150 is configured to display graphic user interface (GUI) to control the audio tuning process or display other messages. The user may begin and end the audio tuning process through the GUI, or monitor the audio tuning process in real time. The user may also select options or set values through the GUI when he has to directly select an option or set a value.

Although FIG. 3 illustrates an exemplary embodiment where the audio tuning system 1000 includes the display 150, the display 150 may be omitted, in which case the audio tuning system 1000 may perform audio tuning of the target device 20 automatically, i.e., without requiring a separate user control.

Figure 4:
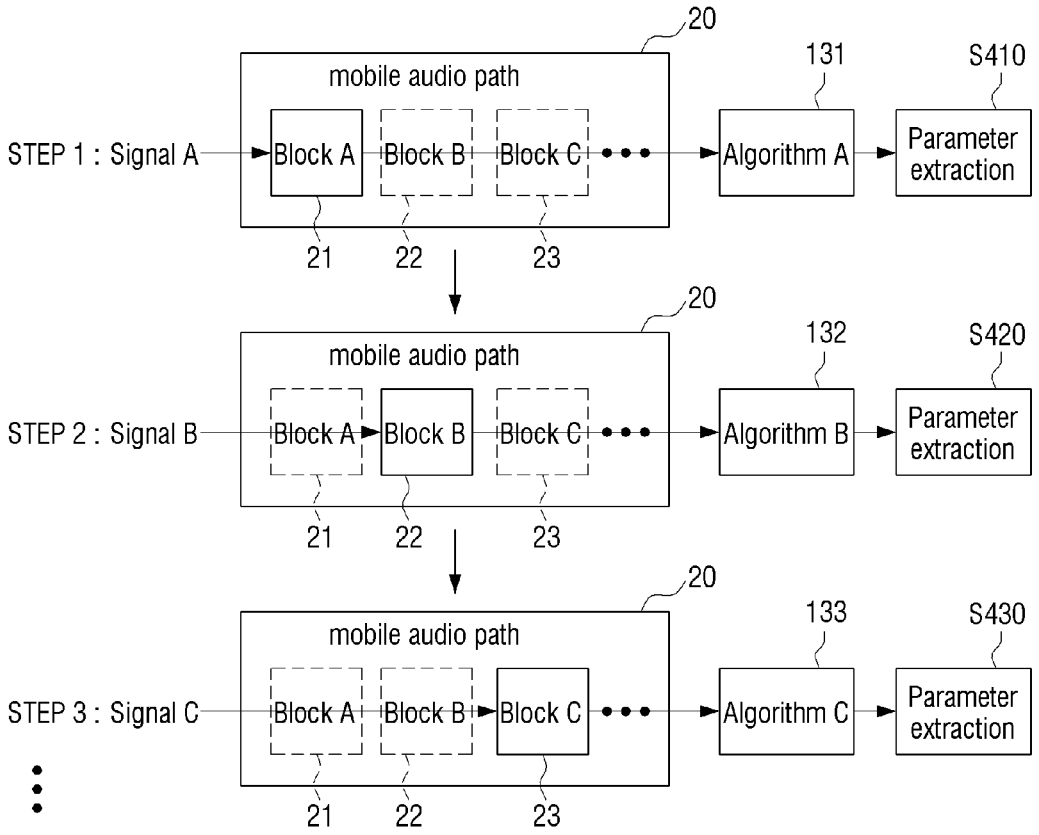
FIG. 4 is a view illustrating an audio tuning processing in a plurality of steps.

FIG. 4 is a view illustrating an audio tuning processing in a plurality of steps.

Referring to FIG. 4, the controller 120 of the audio tuning system 1000 may apply algorithms 131, 132, 133 configured to determine characteristics of the respective audio processing blocks 21, 22, 23 inside the target device 20 through a plurality of steps, and independently analyze the characteristics of the respective blocks. The controller 120 may use the result of such analysis to individually tune the blocks.

As explained above, the audio tuning system 1000 may alternately test the reference device 10 and the target device 20 using respective test signals. Alternatively, the audio tuning system 1000 may test all the characteristics of the audio processing blocks of the reference device 10, and then test the characteristics of the audio processing blocks of the target device 20. Referring to FIG. 4, for convenience of explanation it is assumed that the reference device 10 has completed the test, and the target device 20 is now being tested for tuning.

Further, for convenience of explanation, it is also assumed that in FIG. 4, the blocks A, B, C (21, 22, 23) are a gain set block, a filter block, and an AGC block, respectively.

The controller 120 selects test signal information to test the gain set block 21 among the test signal information stored at the storage 130, using the program module stored at the storage 130, i.e., using the signal selection module.

The controller 120 regenerates a test signal (i.e., a first test signal or signal A) according to the selected test signal information using the signal generator module or the like. The controller 120 may provide the first test signal (or signal A) to the target device 20 via the interface 110. The first test signal may be the one that determines the gain characteristics of the gain set block 21. For example, a signal with flat characteristics in the entire frequency band may be used as the first test signal.

When the first test signal is regenerated as passing the audio path within the target device 20 so that the corresponding audio signal is outputted, the controller 120 acquires the audio signal using the communication module and stores the same in a memory using the recording module. The memory may be a RAM used at the controller 120 or other flash memory. Alternatively, the controller 120 may store the audio signal in the storage 130.

The controller 120 provides the stored audio signal as the result of audio processing of the corresponding block 21. The signal analyzing module analyzes the audio signal, using algorithm A (131) corresponding to the gain set block 21. The signal analyzing module may compare the test result, i.e., audio processing result at the reference device 10 which is tested first, with the test result of the target device 20, to thus analyze the difference.

At operation S410, the controller 120 extracts a parameter set of the target device 20 based on the result of analysis, using the parameter module. Accordingly, the controller 120 sets the gain of the gain set block 21 of the target device 20 according to the extracted parameter set, using the programming module. For example, the controller 120 may set the gain so that the average gain or gain peak of the target device 20 matches the reference device 10. Accordingly, the gain of the target device 20 may be matched with the reference device 10 in the first step.

Next, the controller 120 may select a second test signal to determine filtering characteristics of the filter block 22 and provide the same to the target device 20. Like the first test signal, a signal with flat characteristics in the entire frequency band may be used as the second test signal.

The controller 120 provides the signal analyzing module with the result of audio processing in accordance with the second test signal, as it is acquired. The signal analyzing module analyzes the result of audio processing using an algorithm B (132) corresponding to the filter block 22. Accordingly, the controller 120 may adjust the coefficients of the filtering function used at the filter block 22 of the target device 20, to match the filtering characteristics of the reference device 10.

Next, the controller 120 may provide the target device 20 with a third test signal to determine gain adjustment characteristics of the AGC block 23. For example, an amplitude-swiping signal form may be used as the third test signal.

The controller 120 analyzes the result of audio processing performed at the target device 20 according to the third test signal, using algorithm C (133). The controller 120 may then determine a parameter for the AGC block 23 according to the result of analysis, and tune the AGC block 23 according to the determined parameter. As a result, the gain adjustment characteristics of the target device 20 may be matched to the gain adjustment characteristics of the reference device 10.

The exemplary embodiment above has been described with reference to FIG. 4, where the tuning is performed in the order of the gain set block, the filter block, and the AGC block. However, the order of performing tuning may be determined according to various criteria. For example, the steps may be performed at the controller 120 in the order of higher influence on the other audio processing blocks. Further, although the present exemplary embodiment has been explained so far with reference to the operation at the audio tuning system 1000 by referring to FIG. 4, the present exemplary embodiment is also applicable to a method for performing audio tuning illustrated in FIG. 2. For example, when a plurality of audio processing blocks include a gain set block, a filter block, and an auto gain controller (AGC) block, the tuning at operation S240 of FIG. 2 may include: setting gains of the gain set block of the target device 20 according to the result of the comparison of audio processing results at the reference device 10 and the target device 20 so that the gains of the target device match the gains of the reference device 10; adjusting coefficients of a filtering function used at the filter block of the target device 20 according to the result of the comparison of the audio processing results at the reference device 10 and the target device 20 according to the second test result which is to determine filtering characteristics of the filter block to match the filtering characteristics of the reference device 10, and adjusting gain adjustment parameters of the AGC block of the target device 20 according to the result of the comparison between the reference device 10 and the target device 20 according to the third test signal which is to determine gain adjustment characteristics of the AGC block, to match the gain adjustment characteristics of the reference device 10.

Figure 5:
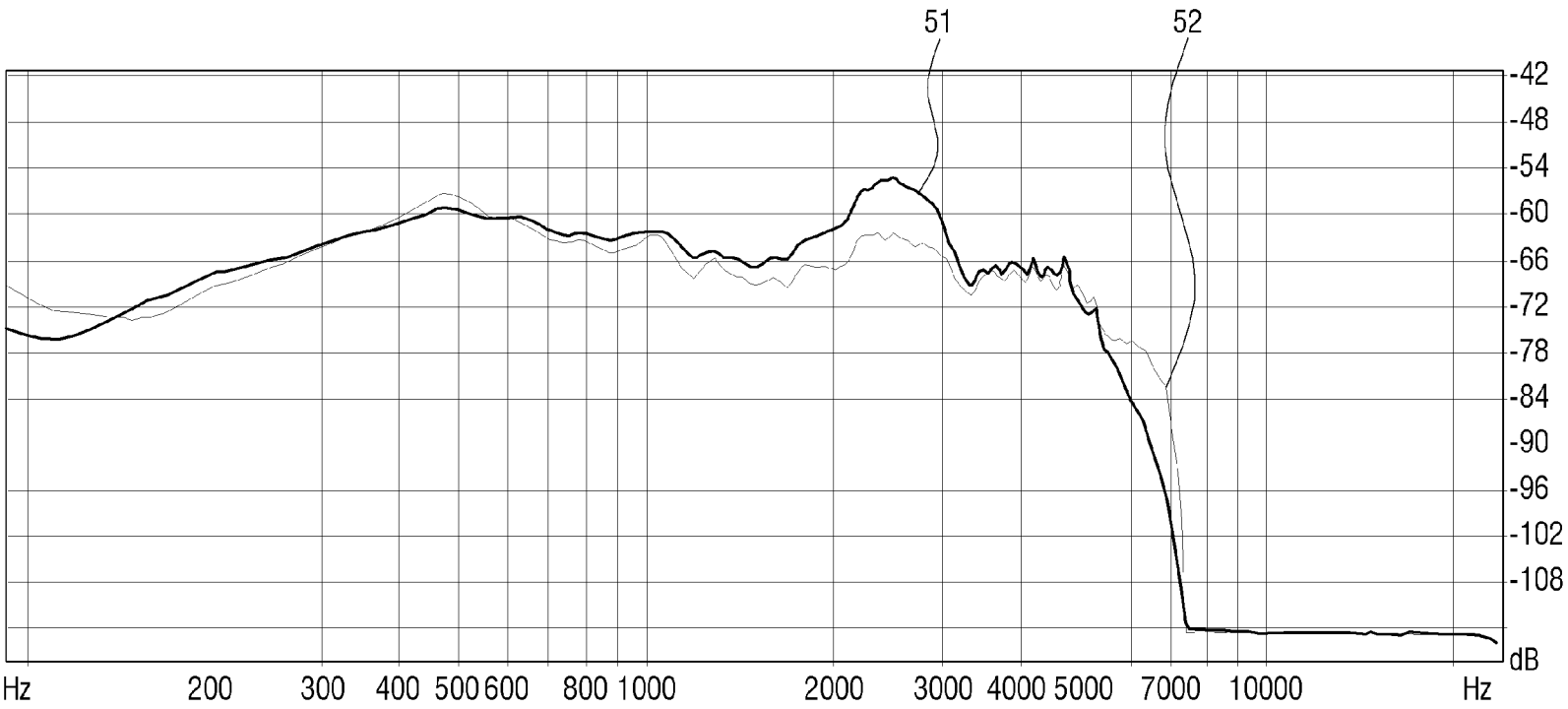
FIGS. 5 to 7 illustrate a result of tuning at some of the steps of FIG. 4.
Figure 6:
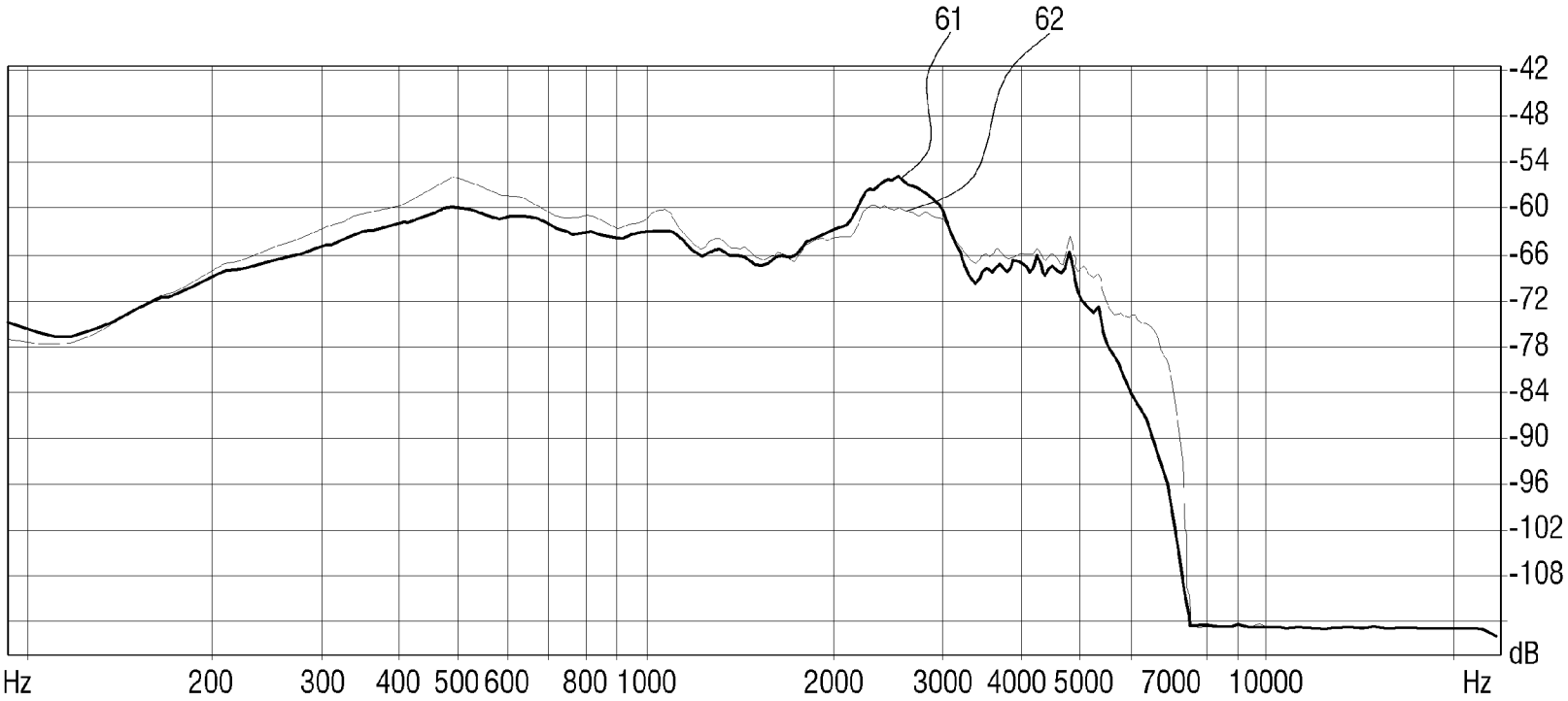
Figure 7:
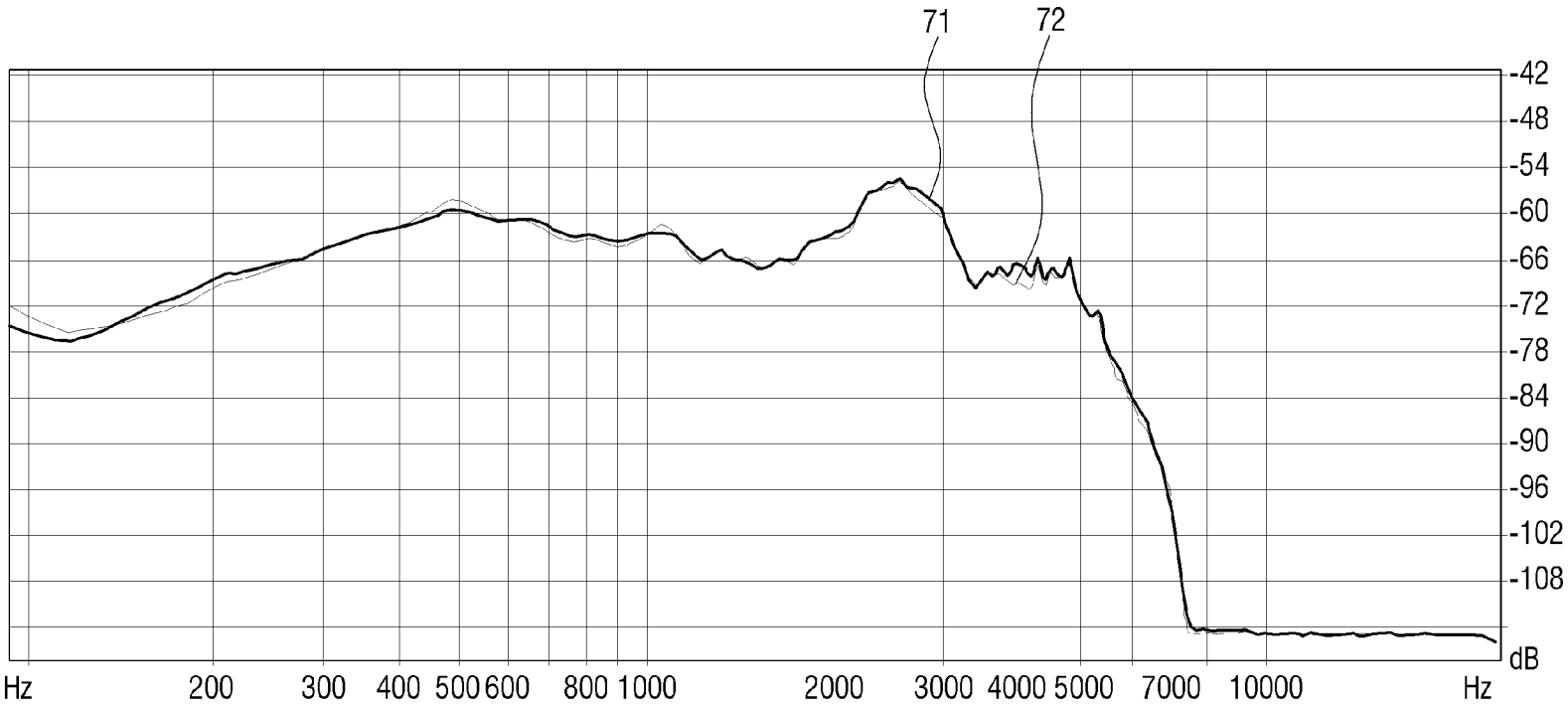

FIGS. 5 to 7 are graphs illustrating signal characteristics between the reference device 10 and the target device 20 which are tuned through the respective steps illustrated in FIG. 4.

FIG. 5 is a graph representing audio characteristics of the reference device 10 and the target device 20 before tuning. Referring to FIG. 5, an audio signal 51 of the reference device 10 and an audio signal 52 of the target device 20 have a considerable difference in the entire frequency band.

FIG. 6 illustrates wavelengths after tuning of the gain adjustment block 21 by the first step (S410). Referring to FIG. 6, the difference between the audio signal 61 of the reference device 10 and the audio signal 62 of the target device 20 is significantly reduced due to gain adjustment at the target device 20.

FIG. 7 illustrates the state in which filtering characteristics of the filter block 21 are matched by the second step (S420). Referring to FIG. 7, the waveforms of the audio signal 71 of the reference device 10 and the audio signal 72 of the target device 20 are mostly matched.

A graph illustrating signal characteristics between the reference device 10 and the target device 20 after tuning the AGC block 21 in the third step (S430) is not illustrated herein.

The graphs of FIGS. 5 to 7 may be displayed on GUI through the display 150 of the audio tuning system 1000. Accordingly, a user performing a tuning operation can check the result of tuning in real time.

As explained above, the audio tuning system 1000 can tune the respective audio processing blocks independently or sequentially, to automatically optimize the audio performance of the target device 20.

Figure 8:
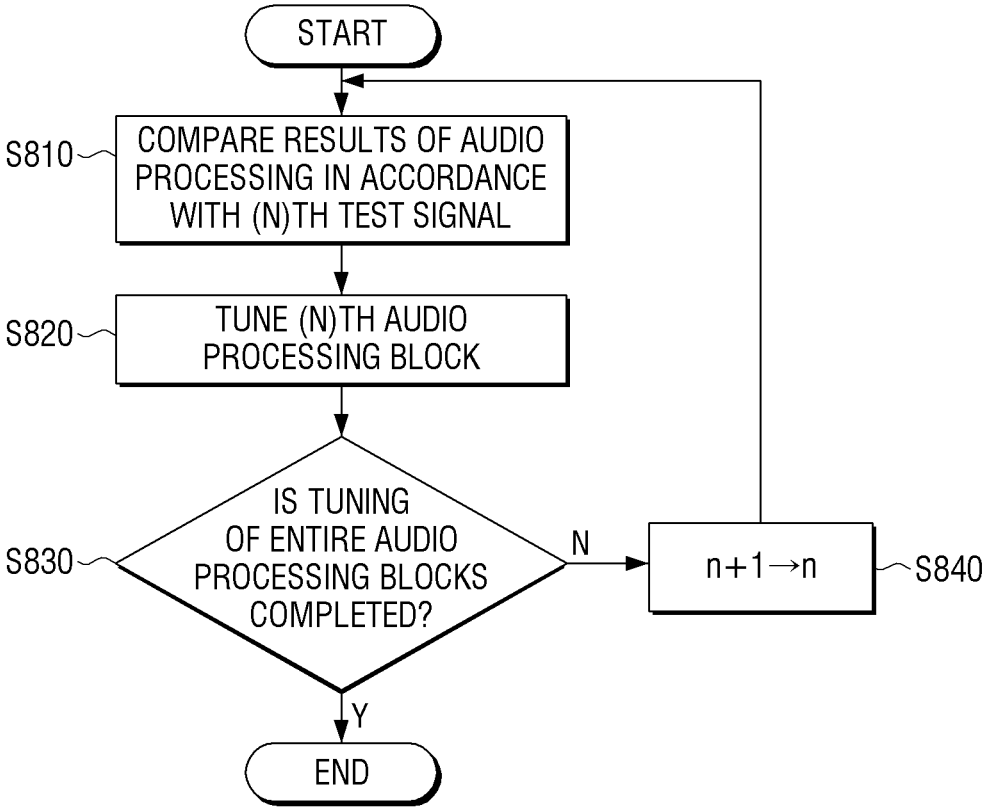
FIG. 8 is a flowchart illustrating an audio tuning method performed in a plurality of steps.

FIG. 8 is a flowchart illustrating an audio tuning method which sequentially performs tuning with respect to a plurality of audio processing blocks.

Referring to FIG. 8, at operation S810, the audio tuning system 1000 may select a test signal that corresponds to an audio processing block that the audio tuning system 1000 intends to test, and compare the results of audio processing at the reference device 10 and the target device 20 according to the test signal. Upon beginning of the initial audio tuning, n may be set to 1.

Referring to FIG. 8, at operation S820, when the test is conducted in accordance with (n)th test signal, the audio tuning system 1000 tunes the (n)th audio processing block.

The audio tuning system 1000 performs audio tuning with respect to the respective audio processing blocks in sequential order until the all of the to-be-tested audio processing blocks are tested. Accordingly, when the tested (n)th audio processing block is a block other than the last audio processing block at operation S830, at operation S840, (n+1) is set to (n), and at operations S810 and S820, tuning for the (n+1)th audio processing block is performed using the (n+1)th test signal.

As a result, audio tuning for the respective audio processing blocks is performed automatically.

Figure 9:
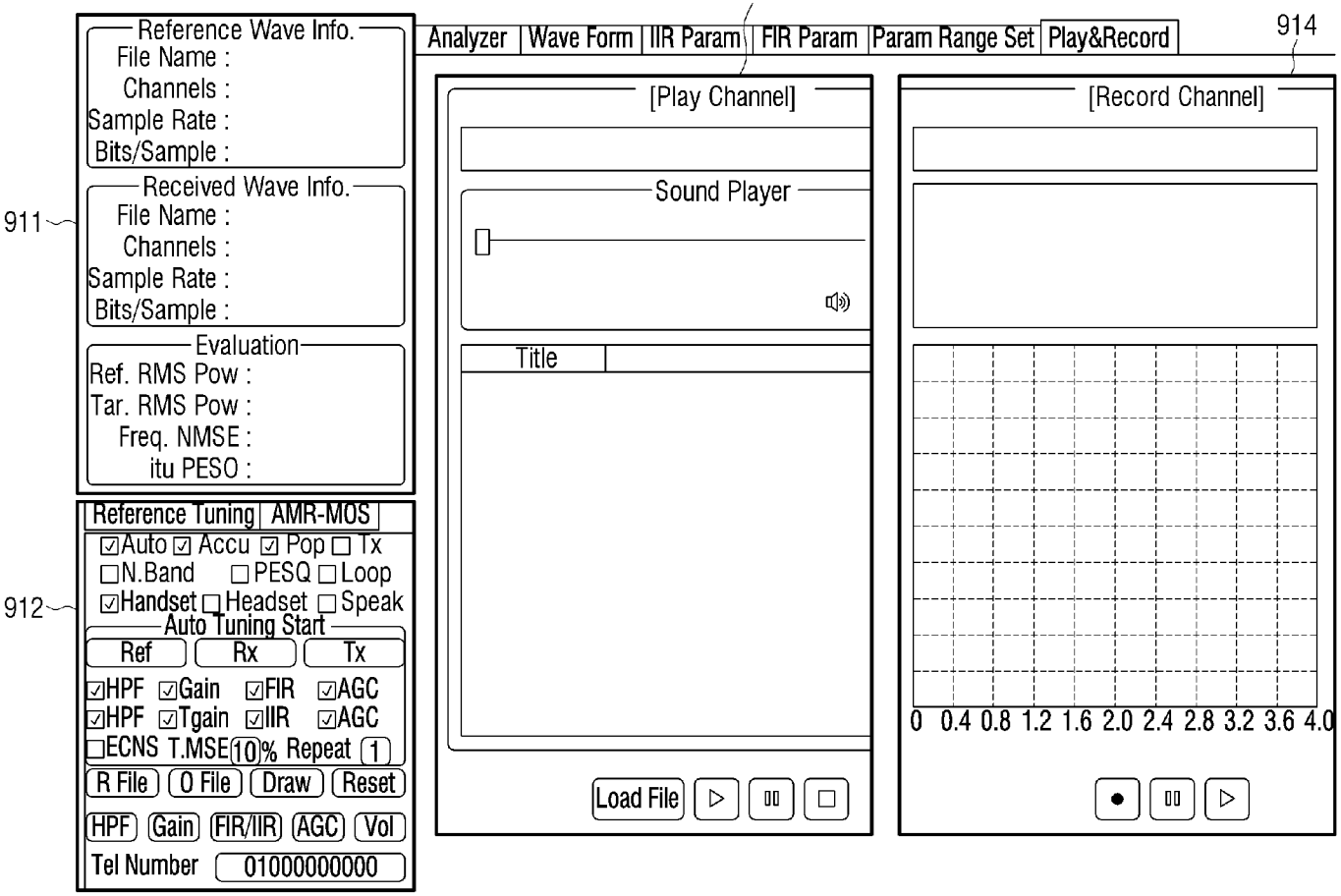
FIGS. 9 and 10 are views illustrating an example of a graphic user interface (GUI) to control audio tuning process.

FIG. 9 illustrates a constitution of GUI for controlling audio tuning process, according to an exemplary embodiment.

Referring to FIG. 9, the GUI 910 displayed on the display 110 may be divided into a plurality of areas. For example, the GUI 910 may be divided into a signal information part 911 which indicates information about the signal outputted from the reference device 10 and the target device 20 and comparison analysis result, a tuning setting part 912 which provides information about a currently-tested mode and audio processing block, a signal generating part 913 which indicates status information about the test signal provided to the target device 20, or a signal recording part 914 which indicates status information about the audio signal outputted from the target device 20.

The user performing testing may check the tuning process in real-time and arbitrarily adjust the tuning process, on the GUI 910.

Figure 10:
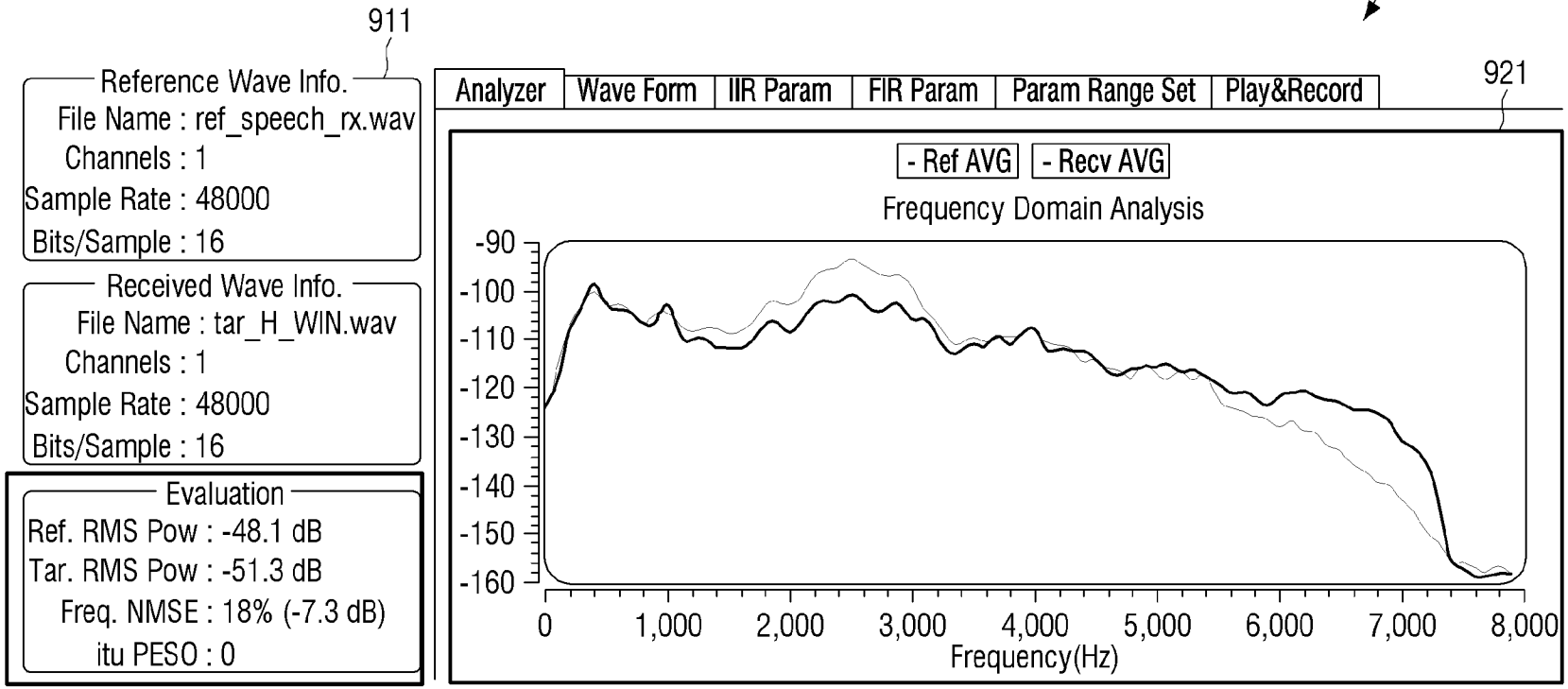

FIG. 10 illustrates a graphic user interface (GUI) 920 displayed in the process of signal analysis, according to an exemplary embodiment. Referring to FIG. 10, as the signal analysis is performed, the GUI 920, including therein frequency response characteristic-representing part 921, is displayed. This part 921 displays frequency response information which is the analysis on the sound source outputted at respective steps, by using corresponding algorithms. Along with this, the signal information part 911 is provided, displaying therein the result of performance evaluation for the target device compared to the reference device in numerical form. When the performance is optimized to above a target level with the performance evaluation, tuning may be completed.

Figure 11:
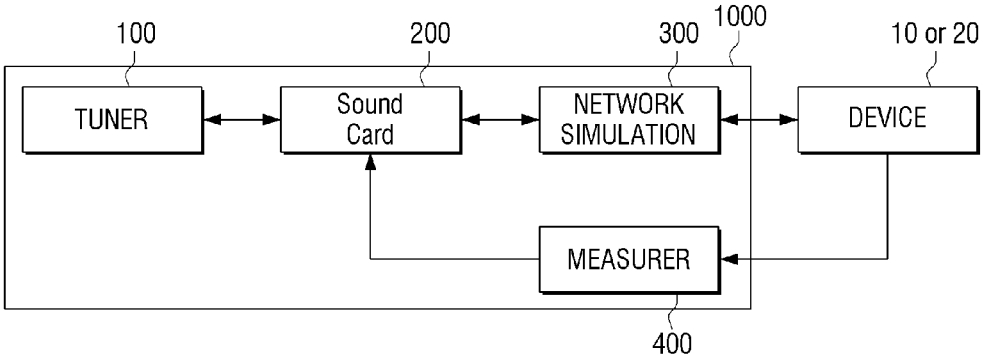
FIG. 11 is a block diagram illustrating a constitution of an audio tuning system according to another exemplary embodiment.

FIG. 11 is a block diagram illustrating the audio tuning system 1000 according to another exemplary embodiment. Referring to FIG. 11, the audio tuning system 1000 may include a tuner 100, a sound card 200, a network simulator 300, and a measurer 400. Each of the devices may be implemented independently.

As explained above, the tuner 100 may select test signals that correspond to respective steps, and output the test signals to the sound card 200. The sound card 200 transmits the outputted test signals to the device via the network simulator 300. The device may be the reference device 10 or the target device 20. That is, when the reference device 10 is connected to the audio tuning system 1000, it is possible to analyze the characteristics of the reference device 10, or when the target device 20 is connected to the audio tuning system 1000, it is possible to analyze the characteristics of the target device 20.

The network simulator 300 performs communication with the device 10 or 20. Accordingly, it is possible to test audio processing characteristics by dividing the operation of the device 10 or 20 into an RX step of receiving voice signal from the network simulator 300 and an TX step of transmitting voice signal to the network simulator 300.

The signal outputted as a result of test signal processing at the device 10 or 20 may be measured with the measurer 400. The measurer 400 may be a variety of devices such as a jig, microphone (MIC), or a head and torso simulator (HATS), depending on the test mode (e.g., headset, handset, hand-free, etc.) The audio signal measured with the measurer 400 may be recorded on the sound card 200.

The sound card 200 provides the recorded audio signal to the tuner 100. The tuner 100 receives an audio signal via the interface 110. The controller 120 of the tuner 100 analyzes the inputted audio signal, i.e., the inputted result of audio processing, according to a corresponding algorithm. Accordingly, the characteristics of the reference device 10 are extracted and the characteristics of the target device 20 are extracted, and these are compared with each other. The controller 120 updates a parameter set of the audio processing block corresponding to the test signal, according to the result of the comparison. The controller 120 programs the updated parameter set to the file system of the target device 20 and enters the next stage. As explained above, the tuner 100 stepwise tests a plurality of audio processing blocks of the target device 20 and adjusts a parameter set or coefficient values. When the respective steps are optimized, the tuning process is completed.

As illustrated in FIG. 11, the tuner 100 may be implemented as one that includes the components of FIG. 1 or 3, but is not limited thereto. For example, the tuner 100 may be implemented as a form that includes not only the components of FIG. 1 or 3, but also includes the sound card 200, the network simulator 300, and the measurer 400.

According to various exemplary embodiments, it is possible to optimize the audio processing performance of the target device 20 to the same level as the reference device 10 such that the target device 20 meets a required performance level. It is also possible to independently analyze the characteristics of a plurality of audio processing blocks which are inter-reliant on each other and perform tuning according to the result of such analysis. Accordingly, time and labor for the tuning can be minimized. As a result, audio performance reliability of the devices waiting for launch is improved, and efficiency of product development is increased based on reduced tuning time and automization.

The audio tuning method and testing method may be implemented as a program code and stored on a non-transitory readable medium for use. An apparatus or a system mounted with the non-transitory readable medium may execute the program code to perform the audio tuning or test according to various exemplary embodiments explained above.

The non-transitory readable medium refers to a device-readable medium which stores data semi-permanently. For instance, the non-transitory readable medium may be CD, DVD, hard disc, Blu-ray disc, USB, memory card, or ROM.

The foregoing exemplary embodiments and advantages are merely exemplary and are not to be construed as limiting the exemplary embodiments. It will be understood by those of ordinary skill in the art that exemplary embodiments may be readily applied to other types of apparatuses. Also, the description of exemplary embodiments t is intended to be illustrative, and not to limit the scope of the claims.

What is claimed is:

1. An audio tuning system comprising:

an interface configured to provide a test signal to a reference device and to a target device;

a controller configured to acquire a result of audio processing in response to the test signal from the reference device and a result of audio processing in response to the test signal from the target device, compare the results, and adjust an audio processing characteristic value of the target device to match that of the reference device based on a result of the comparison; and a storage configured to store test signal information for each of a plurality of audio processing blocks, wherein when the target device has a plurality of audio processing blocks, the controller is further configured to provide the target device with the plurality of test signals, acquire results of audio processing in response to the plurality of test signals at the plurality of audio processing blocks of the target device, compare the acquired results of audio processing, and adjust, in a stepwise manner, audio processing characteristic values of the plurality of audio processing blocks of the target device, based on a result of the comparing.

2. The audio tuning system of claim 1, further comprising:

an audio processor configured to regenerate a plurality of test signals according to the test signal information, wherein the controller is further configured to sequentially provide the reference device with the plurality of test signals via the interface, and sequentially acquire results of audio processing in response to the plurality of test signals at the plurality of audio processing blocks of the reference device.

3. The audio tuning system of claim 2, further comprising a display configured to display a graphic user interface to control an audio tuning process of the target device.

4. The audio tuning system of claim 2, wherein the plurality of audio processing blocks of the target device and the reference device comprise a gain set block, a filter block, and an auto gain controller (AGC) block, and the controller is further configured to:

provide the reference device and the target device with a first test signal to determine a gain characteristic of the gain set block of the reference device and a gain characteristic of the gain set block of the target device, and set a gain of the gain set block of the target device to match the gain characteristic of the gain set block of the reference device, provide the reference device and the target device with a second test signal to determine a filtering characteristic of the filter block of the reference device and a filtering characteristic of the filter block of the target device, and adjust a coefficient of a filtering function of the filter block of the target device to match the filtering characteristic of the filter block of the reference device, and provide the reference device and the target device with a third test signal to determine a gain adjustment characteristic of the AGC block of the reference device and a gain adjustment characteristic of the AGC block of the target device, and adjust a gain adjustment parameter of the AGC block of the target device to match the gain adjustment characteristic of the AGC block of the reference device.

5. The audio tuning system of claim 4, wherein the interface is connected to a sound card which is configured to record an audio signal, that is output as a result of processing the test signal at the reference device and the target device, thereby acquiring the result of the audio processing, and the controller is further configured to receive the result of audio processing from the sound card via the interface.

6. The audio tuning system of claim 2, wherein the plurality of audio processing blocks comprise at least two blocks from among a gain set block, a filter block, an auto gain controller (AGC) block, an echo canceller block, and a noise suppression block.

7. The audio tuning system of claim 1, wherein the controller is further configured to obtain information about audio processing of the target device.

8. An audio tuning method of an audio tuning system, the audio tuning method comprising:

providing a test signal to a reference device;

acquiring a result of audio processing in response to the test signal from the reference device;

providing the test signal to a target device;

acquiring a result of audio processing in response to the test signal from the target device; and tuning the target device, the tuning comprising comparing the results of audio processing at the reference device and the target device, and adjusting an audio processing characteristic value of the target device to match an audio processing characteristic value of the reference device, wherein the test signal comprises a plurality of test signals regenerated with respect to respective audio processing blocks in accordance with test signal information, and wherein when the target device has a plurality of audio processing blocks, providing the test signal comprises providing the target device with the plurality of test signals, acquiring the result comprises acquiring results of audio processing in response to the plurality of test signals at the plurality of audio processing blocks of the target device, tuning the target device comprises comparing the acquired results of audio processing and adjusting, in a stepwise manner, audio processing characteristic values of the plurality of audio processing blocks of the target device, based on a result of the comparing.

9. The audio tuning method of claim 8, wherein the providing the test signal to the reference device comprises sequentially providing the plurality of test signals to reference device, and the acquiring the result of audio processing in response to the test signal from the reference device comprises sequentially acquiring results of audio processing at the plurality of audio processing blocks of the reference device.

10. The audio tuning method of claim 9, wherein the plurality of audio processing blocks comprise: a gain set block, a filter block, and an auto gain controller (AGC) block, and the tuning comprises:

comparing results of audio processing at the reference device and the target device in response to a first test signal which is to determine a gain characteristic of the gain set block of the reference device and a gain characteristic of the gain set block of the target device, and setting a gain of the gain set block of the target device to match the gain characteristic of the gain set block of the reference device according to a result of the comparison;

comparing results of audio processing at the reference device and the target device in response to a second test signal which is to determine a filtering characteristic of the filter block of the reference device and a filtering characteristic of the filter block of the target device, and adjusting a coefficient of a filtering function used in the filter block of the target device to match the filtering characteristic of the filter block of the reference device; and comparing results of audio processing at the reference device and the target device in response to a third test signal which is to determine a gain adjustment characteristic of the AGC block of the reference device and a gain adjustment characteristic of the AGC block of the target device, and adjusting a gain adjustment parameter of the AGC block of the target device to match the gain adjustment characteristic of the AGC block of the reference device.

11. The audio tuning method of claim 10, wherein the results of audio processing in response to the test signals are received from a sound card which acquires the results of audio processing by recording an audio signal outputted as a result of processing the test signals at the reference device and the target device.

12. The audio tuning method of claim 8, wherein the plurality of audio processing blocks comprise at least two blocks from among a gain set block, a filter block, an auto gain controller (AGC) block, an echo canceller block, and a noise suppression block.

13. An audio tuning system comprising:

an interface configured to provide a test signal to a reference device and a target device;

a controller configured to receive a first result of audio processing of the test signal at the reference device and a second result of audio processing of the test signal at the target device, compare the first result with the second result, and adjust an audio processing characteristic value of the target device based on a result of the comparison; and a storage configured to store test signal information for each of a plurality of audio processing blocks, wherein when the target device has a plurality of audio processing blocks, the controller is further configured to provide the target device with the plurality of test signals, acquire results of audio processing in response to the plurality of test signals at the plurality of audio processing blocks of the target device, compare the acquired results of audio processing, and adjust, in a stepwise manner, audio processing characteristic values of the plurality of audio processing blocks of the target device, based on a result of the comparing.

14. The audio tuning system of claim 13, wherein the audio processing characteristic value of the target device is adjusted to match an audio processing characteristic value of the reference device.

15. The audio tuning system of claim 13, wherein the controller is configured to:

sequentially provide test signals of the plurality of test signal to the reference device which correspond to audio processing blocks of the reference device, sequentially provide the test signals to the target device, and sequentially acquire results of audio processing at the plurality of audio processing blocks of the reference device and the target device, respectively.

16. The audio tuning system of claim 15, wherein the plurality of audio processing blocks comprise: a gain set block; a filter block; and an auto gain controller (AGC) block.

17. The audio tuning system of claim 15, wherein the plurality of audio processing blocks comprises at least two blocks selected from the group consisting of: a gain set block, a filter block, an auto gain controller (AGC) block, an echo canceller block, and a noise suppression block.

* * * * *